US008992251B2

(12) United States Patent
Smutny et al.

(10) Patent No.: US 8,992,251 B2
(45) Date of Patent: Mar. 31, 2015

(54) ELECTRICAL SPLICE ASSEMBLY

(71) Applicant: Delphi Technologies, Inc., Troy, MI (US)

(72) Inventors: Dale J. Smutny, Canfield, OH (US); Wesley W. Weber, Jr., Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 91 days.

(21) Appl. No.: 13/846,965

(22) Filed: Mar. 19, 2013

(65) Prior Publication Data

US 2014/0287621 A1 Sep. 25, 2014

(51) Int. Cl.

| | |
|---|---|
| ***H01R 33/02*** | (2006.01) |
| ***H01R 31/08*** | (2006.01) |
| *H01R 13/11* | (2006.01) |
| *H01R 13/422* | (2006.01) |
| *H01R 107/00* | (2006.01) |

(52) U.S. Cl.

CPC ..... *H01R 31/08* (2013.01); *H01R 13/114* (2013.01); *H01R 13/4223* (2013.01); *H01R 2107/00* (2013.01)

USPC ..... 439/595; 439/511

(58) Field of Classification Search

USPC ..... 439/595, 511, 189, 752

See application file for complete search history.

(56) References Cited

U.S. PATENT DOCUMENTS

| | | | | |
|---|---|---|---|---|
| 5,556,301 | A * | 9/1996 | Chishima et al. | 439/507 |
| 5,662,487 | A * | 9/1997 | Okamura et al. | 439/189 |
| 5,901,441 | A | 5/1999 | Kawamura et al. | |
| 6,193,549 | B1 * | 2/2001 | Suzuki et al. | 439/589 |
| 6,354,873 | B1 * | 3/2002 | Morello et al. | 439/595 |
| 7,241,168 | B2 * | 7/2007 | Sakurai et al. | 439/511 |
| 7,396,522 | B2 * | 7/2008 | Ayyer et al. | 423/573.1 |
| 7,883,362 | B2 * | 2/2011 | Ichio et al. | 439/511 |
| 7,980,872 | B1 | 7/2011 | Smutny et al. | |
| 8,083,543 | B2 * | 12/2011 | Omori et al. | 439/511 |
| 8,257,111 | B1 | 9/2012 | Smutny et al. | |
| 2005/0255749 | A1 * | 11/2005 | Swantner | 439/595 |
| 2008/0081507 | A1 | 4/2008 | Mahajan | |
| 2010/0029129 | A1 | 2/2010 | Cox et al. | |
| 2010/0041272 | A1 * | 2/2010 | Morello et al. | 439/595 |

* cited by examiner

*Primary Examiner* — Gary Paumen

(74) *Attorney, Agent, or Firm* — Thomas N. Twomey

(57) ABSTRACT

An electrical splice assembly includes a housing having a forward portion, a rearward portion, and an intermediate portion defining a plurality of terminal retention cavities between the forward portion and the rearward portion. A conductive bus plate is retained within the forward portion of the housing. A plurality of terminals each extend into a respective terminal retention cavity and each terminal is in electrical contact with the bus plate. Each of the terminal retention cavities is defined by 1) a pair of opposing sidewalls connected to the forward portion and to the rearward portion and 2) a pair of opposing retention beams. The retention beams each include a latch which engages a respective terminal to retain the terminals in the terminal retention cavities.

20 Claims, 6 Drawing Sheets

ELECTRICAL SPLICE ASSEMBLY

TECHNICAL FIELD OF INVENTION

The present invention relates to electrical splice assemblies for electrically connecting a plurality of electric cables.

BACKGROUND OF INVENTION

Splice assemblies are used, for example, in automotive applications in which a centralized connector is needed to connect one or more main cables to one or more branching cables. One such splice arrangement is known as an insulation displacement crimp (IDC) splice. United States Patent Application Publication No. US 2010/0029129 A1 to Cox et al. discloses an example of such an IDC splice. Cox et al. teaches that first and second wires are spliced using an electrically conductive IDC element which takes the form of an elongated U-shape. The IDC element includes a main base portion that connects first and second end portions. The first and second end portions each include a funnel or V-shaped wire reception slot that is configured to engage the wires that are to be spliced. In order to splice the first and second wires, the wires are forced into the respective V-shaped wire reception slot where insulation of the wires is displaced and the conductive core of the wires makes electrical contact with the IDC element, thereby placing the first wire in electrical communication with the second wire through the IDC element. IDC splice assemblies may be acceptable in some applications, however, some conductive core materials, for example aluminum, may not perform adequately in such IDC splice assemblies. Furthermore, IDC splice assemblies may not perform adequately in environments that are subjected to certain vibrations.

U.S. Pat. No. 5,901,441 to Kawamura et al. teaches another splice arrangement. Kawarmura et al. teaches that multiple wires are spliced by first stripping the insulation away from the ends of the conductors of each of the wires that are to be spliced. The exposed conductors are then subjected to an ultrasonic welding process to form the splice. This method of splicing is categorized as an off-line process and requires a separate station to complete. Consequently, the process may be time and cost intensive.

U.S. Pat. No. 7,980,872 to Smutny et al. teaches another splice arrangement. Smutny et al. teaches an insulative housing with a terminal receiving tray which receives a plurality of terminals. The terminals are held in place by a cover of the housing which is formed integrally with the housing. After all of the terminals are positioned in the receiving tray, the cover is closed, thereby retaining the terminals within the housing. A bus plate within the housing places the terminals in electrical communication with each other. This splice arrangement may require all of the terminals to be positioned within the housing before any of the terminals can be positively retained within the housing.

Other known splice assemblies may include multiple insulative bodies or housings which must be connected together. Such splice assemblies that include multiple insulative bodies or housings may be time and cost intensive.

What is needed is a splice assembly which minimizes or eliminates one or more of the shortcomings as set forth above.

SUMMARY OF THE INVENTION

Briefly described an electrical splice assembly is provided for placing a plurality of wires in electrical communication. The electrical splice assembly includes an insulative housing extending along an axis and having a forward portion, a rearward portion, and an intermediate portion between the forward portion and the rearward portion. The intermediate portion defines a plurality of axially extending terminal retention cavities. A conductive bus plate is retained within the forward portion of the housing. A plurality of conductive terminals each extend into a respective one of the plurality of terminal retention cavities and are each in electrical contact with the bus plate. Each of the terminal retention cavities is defined by 1) a pair of opposing sidewalls connected to the forward portion and to the rearward portion and 2) a pair of opposing retention beams. The retention beams each include a latch which engages a respective one of the plurality of terminals to retain the terminals in the terminal retention cavities.

BRIEF DESCRIPTION OF DRAWINGS

This invention will be further described with reference to the accompanying drawings in which.

DETAILED DESCRIPTION OF INVENTION

Figure 1:
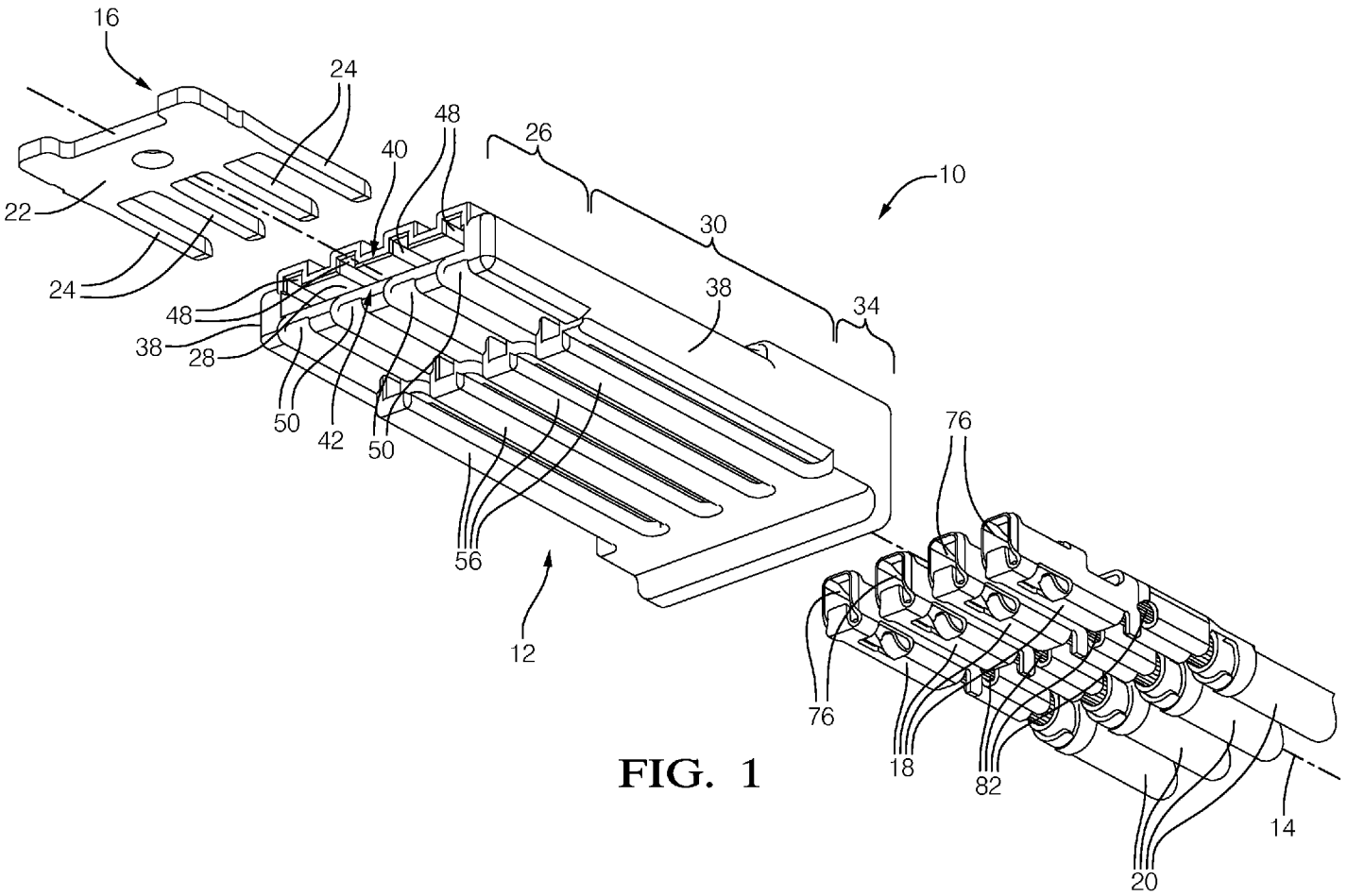
FIG. 1 is an isometric exploded view of an electrical splice assembly in accordance with the present invention.
Figure 2:
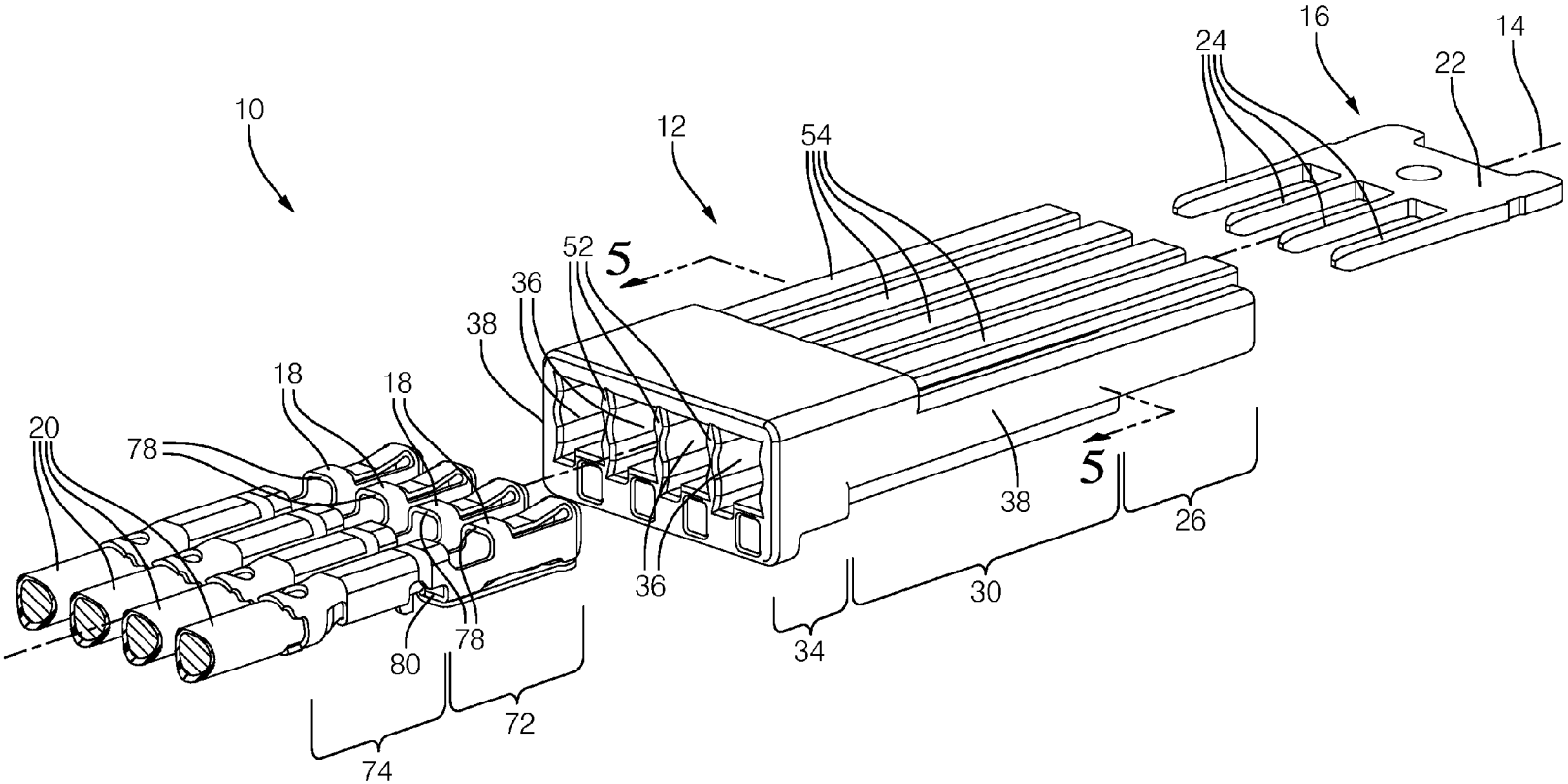
FIG. 2 is an isometric exploded view of the electrical splice assembly in accordance with the present invention taken from a different perspective than the isometric exploded view of FIG. 1.

Referring now to the drawings wherein like reference numerals are used to identify identical components in the various views, FIGS. 1-5 illustrate an exemplary electrical splice assembly 10. Electrical splice assembly 10 includes an electrically insulative housing 12 extending along a housing axis 14, a conductive bus plate 16, and a plurality of conductive terminals 18 that are attached to respective exposed ends of insulated electric cables 20. Bus plate 16 provides electrical communication between terminals 18, and consequently, each electric cable 20 is in electrical communication with the other electric cables 20.

Bus plate 16 includes an elongated strip 22 with a plurality of blades 24 extending therefrom. Blades 24 are coplanar with strip 22 and each blade 24 extends in substantially the same direction from strip 22 in the direction of housing axis 14.

Housing 12 includes a forward portion 26 defining a bus plate retainer 28, an intermediate portion 30 defining a plurality of longitudinally extending terminal retention cavities 32, and a rearward portion 34 defining terminal retention cavity entrances 36.

Bus plate retainer 28 is defined by opposing housing sidewalls 38 which extend axially the length of housing 12 from forward portion 26 to rearward portion 34. Bus plate retainer 28 is also defined by opposing bus plate retainer walls 40, 42 which span between housing sidewalls 38. Bus plate retainer walls 40, 42 extend axially and terminate at intermediate portion 30. A partition 44 terminates bus plate retainer 28 at terminal retention cavities 32. Partition 44 may be substantially perpendicular to housing axis 14 and includes a plurality of interior partition apertures 46 extending axially through partition 44 and a plurality of exterior partition apertures 47 extending axially through partition 44. Each interior partition aperture 46 provides communication between bus plate retainer 28 and a respective one of terminal retention cavities 32. Interior partition apertures 32 are each sized to allow a respective one of blades 24 to extend axially therethrough into a respective terminal retention cavity 32 to mate with a respective terminal 18 as will be described in greater detail later. Bus plate retainer 28 may be sized to receive bus plate 16 in a press fit relationship in order to prevent unintended removal of bus plate 16 from bus plate retainer 28.

The inside surface of bus plate retainer wall 40 includes interior grooves 48 which extend axially into forward portion 26. Each interior groove 48 is axially aligned with a respective terminal retention cavity 32. Each interior groove 48 is also axially aligned with a portion of a respective interior partition aperture 46 as will be described in greater detail later. The inside surface of bus plate retainer wall 42 may be substantially planar and terminates at partition 44. The outside surface of bus plate retainer wall 42 includes exterior grooves 50 which extend axially along forward portion 26. Each exterior groove 50 is axially aligned with a respective terminal retention cavity 32. Each exterior groove 50 communicates with a respective terminal retention cavity 32 through a respective exterior partition aperture 47.

Intermediate portion 30 is defined in part by housing sidewalls 38 which extend axially the length of housing 12 from forward portion 26 to rearward portion 34. Housing sidewalls 38 together with a plurality of interior sidewalls 52 partly define terminal retention cavities 32. Interior sidewalls 52 are equally spaced between housing sidewalls 38 and extend axially from rearward portion 34 to partition 44 in a direction that is substantially parallel to housing sidewalls 38. Intermediate portion 30 and terminal retention cavities 32 are also partly defined by a plurality of first retention beams 54 and a plurality of second retention beams 56 which are opposed to first retention beams 54. First retention beams 54 and second retention beams 56 extend axially from forward portion 26 to rearward portion 34 and are attached only at forward portion 26 and rearward portion 34, i.e. first retention beams 54 and second retention beams 56 are not attached to housing side walls 38 and interior sidewalls 52 along at least a portion of intermediate portion 30 which may be best seen in FIG. 5. First retention beams 54 and second retention beams 56 are substantially perpendicular to housing sidewalls 38 and interior sidewalls 52, thereby giving terminal retention cavities 32 a substantially rectangular or square cross-sectional shape when cut by a plane that is substantially perpendicular to housing axis 14. An axially extending slot is defined between each adjacent first retention beam 54 and an axially extending slot is also defined between each adjacent second retention beam 56. First retention beams 54 and second retention beams 56 are compliant and resilient as will be described in greater detail later.

First retention beams 54 each have a first latch 58 that extends from first retention beam 54 into terminal retention cavity 32. First latch 58 includes a first latch ramp portion 60 which faces toward rearward portion 34 and which is oblique to housing axis 14. First latch 58 also includes a first latch shoulder portion 62 which faces toward forward portion 26 and which is substantially perpendicular to housing axis 14. Each first latch 58 is axially aligned with a respective one of interior partition apertures 46. Each first latch 58 is used to retain a respective terminal 18 in a respective terminal retention cavity 32 as will be described in greater detail later.

Second retention beams 56 each have a second latch 64 that extends from second retention beam 56 into terminal retention cavity 32. Second latch 64 includes a second latch ramp portion 66 which faces toward rearward portion 34 and which is oblique to housing axis 14. Second latch 64 also includes a second latch shoulder portion 68 which faces toward forward portion 26 and which is substantially perpendicular to housing axis 14. Each second latch 64 is axially aligned with a respective one of exterior partition apertures 47. Each second latch 64 is used to retain a respective terminal 18 in a respective terminal retention cavity 32 as will be described in greater detail later.

Terminal retention cavity entrances 36, which are defined by rearward portion 34, extend axially through rearward portion 34. Each terminal retention cavity entrance 36 provides access to a respective terminal retention cavity 32.

Each terminal 18 has a box-shaped mating portion 72 and a crimp section 74. The axial end of mating portion 72 distal from crimp section 74 has a receptor 76 configured to receive a respective blade 24 of bus plate 16 therein. One side of mating portion 72 includes an opening therein defining a first terminal shoulder 78 while the axial end of mating portion 72 proximal to crimp section 74 defines a second terminal shoulder 80. The opening defining first terminal shoulder 78 is sufficiently large to receive first latch 58 therein. Crimp section 74 is configured to be crimped to electric cable 20 to provide electrical communication from a conductive core 82 of electric cable 20 to terminal 18.

Figure 6:
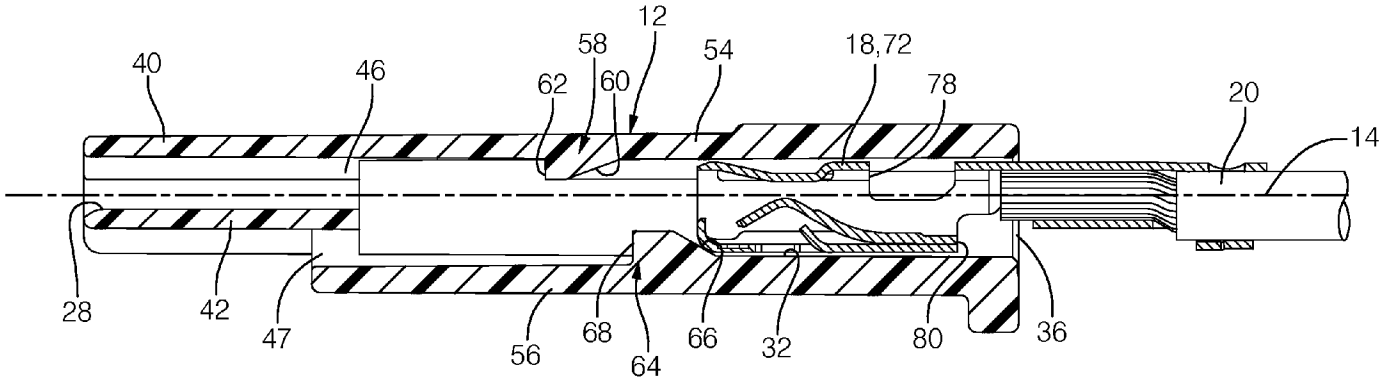
FIGS. 6-10 show an assembly progression of the electrical splice assembly in accordance with the present invention.
Figure 7:
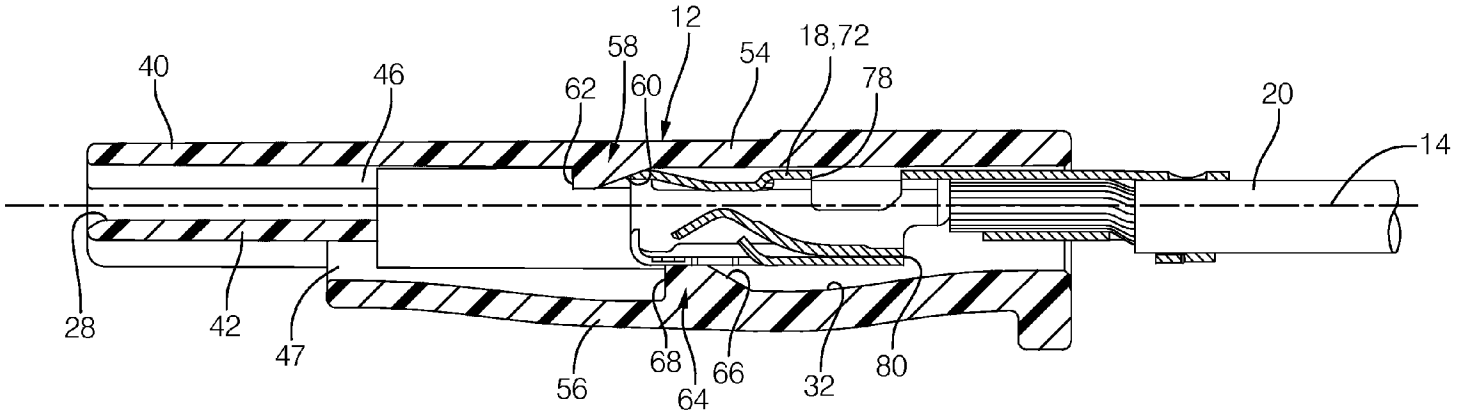
Figure 8:
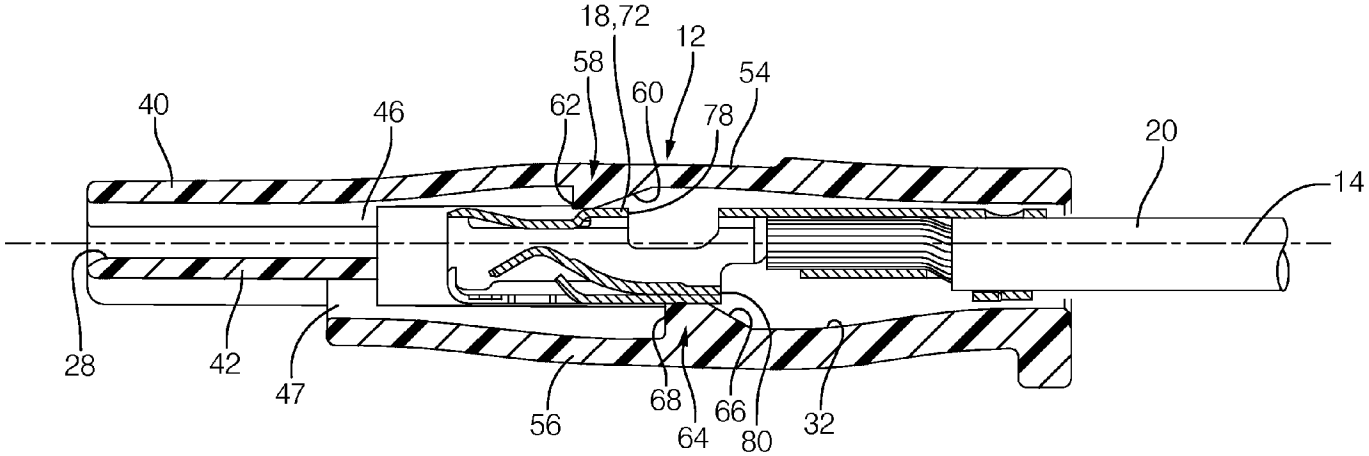
Figure 9:
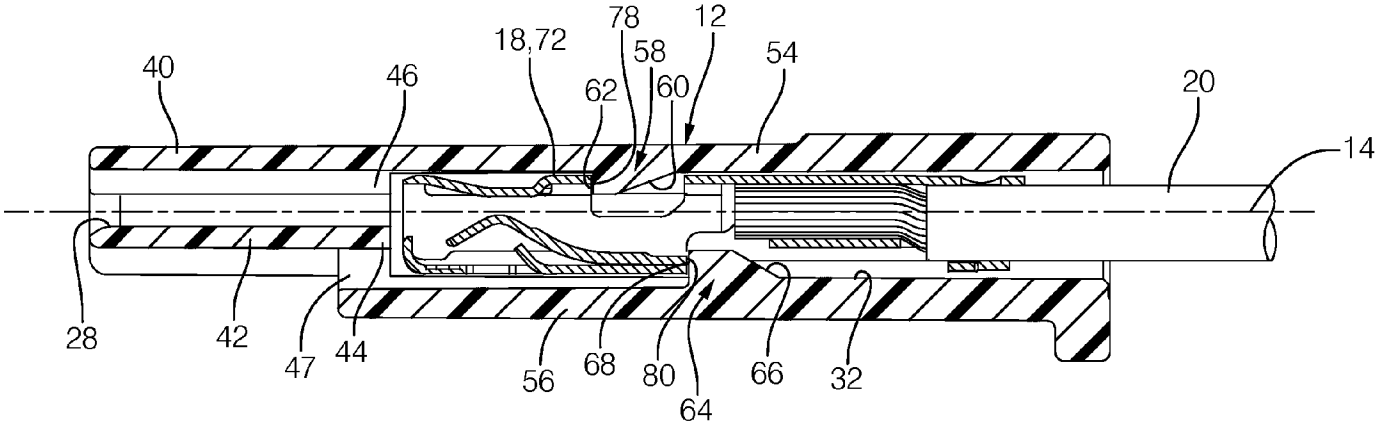

Reference will now be made to FIGS. 6-10 which show a progression of assembly of electrical splice assembly 10. In FIG. 6, terminal 18 is shown axially inserted into terminal retention cavity entrance 36 just prior to terminal 18 coming into contact with second latch 64. In FIG. 7 terminal 18 is shown advanced part way into terminal retention cavity 32 such that mating portion 72 of terminal 18 has advanced over second latch ramp portion 66, thereby causing second retention beam 56 to flex resiliently outward from terminal retention cavity 32. In FIG. 8, terminal 18 is shown advanced further into terminal retention cavity 32 than in FIG. 7 such that mating portion 72 of terminal 18 has advanced over first latch ramp portion 60, thereby causing first retention beam 54 to flex resiliently outward from terminal retention cavity 32. As can be seen, second retention beam 56 remains flexed resiliently outward from terminal retention cavity 32. In FIG. 9, terminal 18 is shown fully inserted into terminal retention cavity 32. When this happens, first latch 58 is aligned with the opening which defines first terminal shoulder 78, thereby allowing first retention beam 54 to snap inward such that first terminal shoulder 78 engages first latch shoulder portion 62 to prevent removal of terminal 18 from terminal retention cavity 32. Simultaneously, second latch 64 passes over the axial end of mating portion 72 that defines second terminal shoulder 80, thereby allowing second retention beam 56 to snap inward such that second terminal shoulder 80 engages second latch shoulder portion 68 to prevent removal of terminal 18 from terminal retention cavity 32. While the insertion of one terminal 18 has been described, the process is the same for each terminal 18. Furthermore, since each first retention beam 54 and second retention beam 56 of a respective terminal retention cavity 32 operates independently of every other first retention beam 54 and second retention beam 56 of respective terminal retention cavities 32, each terminal 18 may be inserted either separately or simultaneously without having a terminal 18 being inadvertently removed from its respective terminal retention cavity 32.

Figure 3:
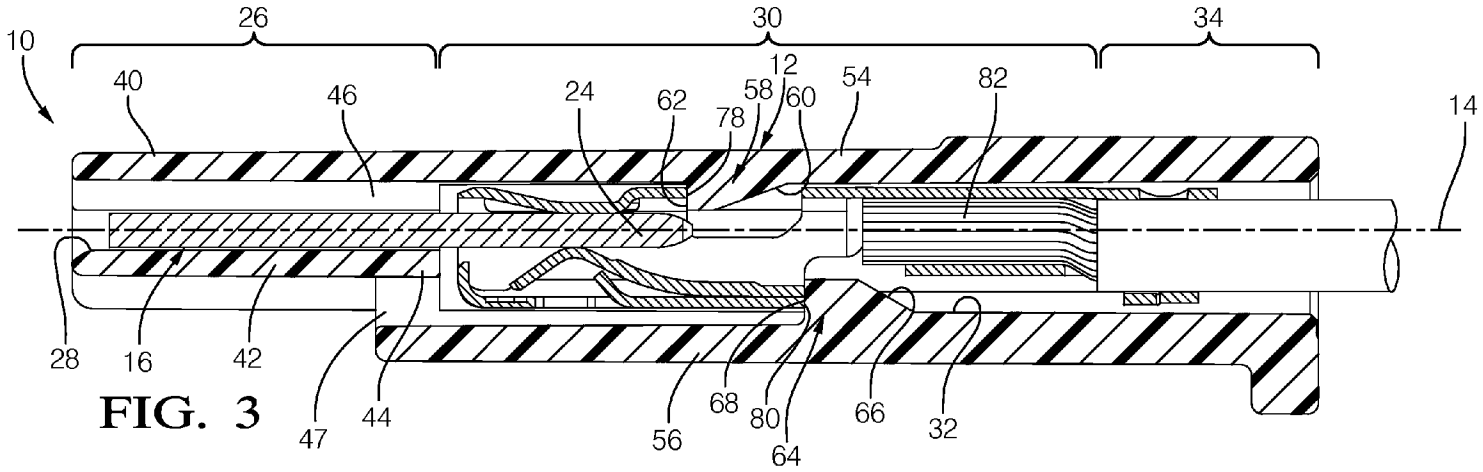
FIG. 3 is cross-section view of the electrical splice assembly in accordance with the present invention.
Figure 4:
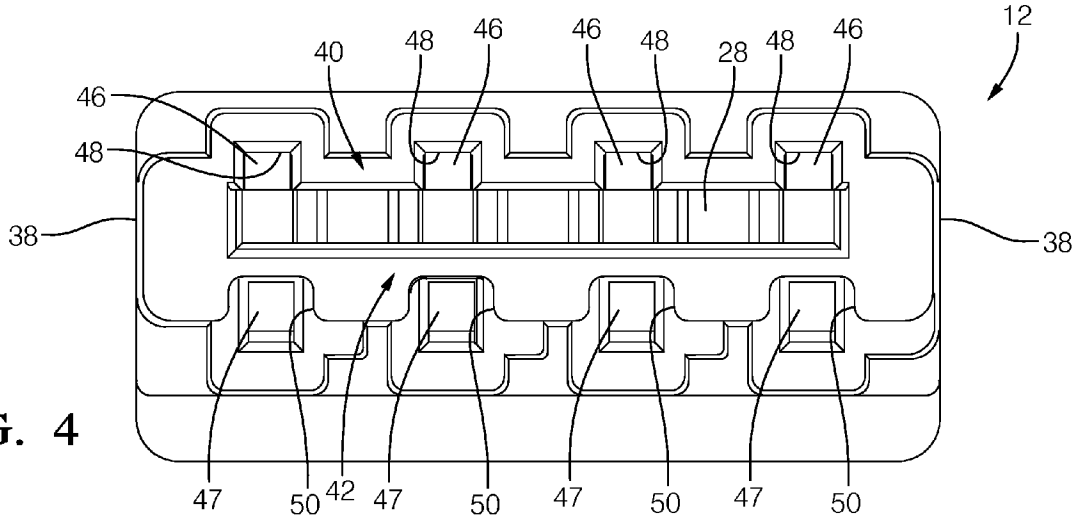
FIG. 4 is an end view of a housing of the electrical splice assembly in accordance with the present invention.
Figure 5:
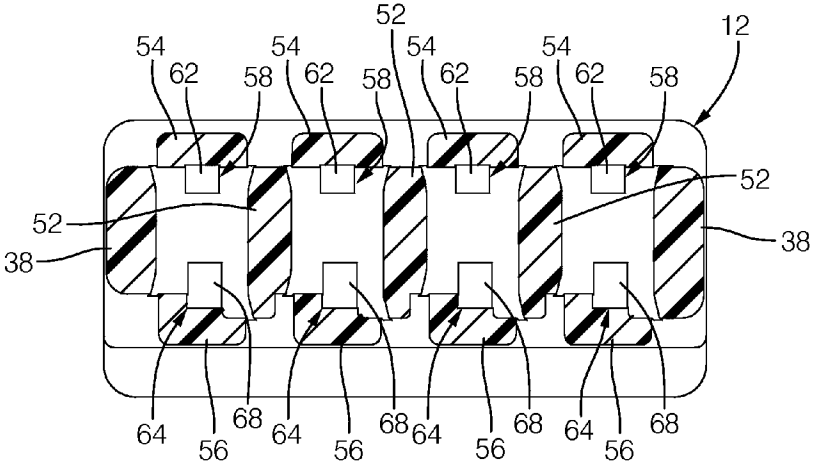
FIG. 5 is a cross sectional view of the housing of the electrical splice assembly in accordance with the invention taken through section line 5-5 of FIG. 2.
Figure 10:
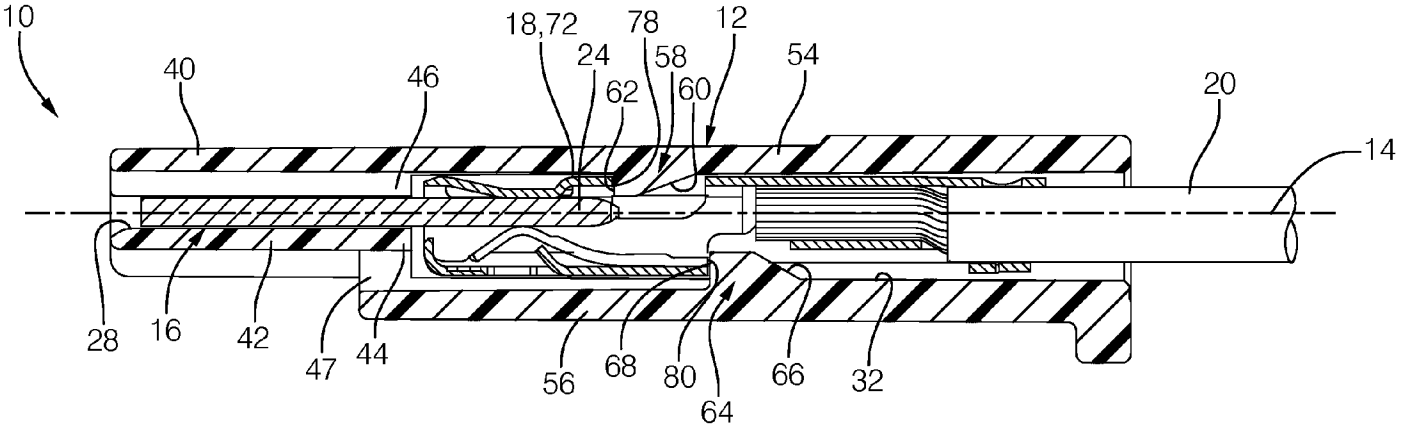

In FIGS. 3 and 10, bus plate 16 is shown fully inserted into bus plate retainer 28 such that blades 24 pass through respective interior partition apertures 46 into respective receptors 76 of terminals 18. In this way, bus plate 16 provides electrical communication between each electric cables 20. While bus plate 16 has been describe as being positioned after terminals 18 are positioned, it should be understand that this order may be reversed.

Housing 12 is easily molded by a plastic injection molding process using mold halves (not shown) without the need for slides. This ease of molding is permitted due to first latch 58 being axially aligned with interior partition apertures 46 and interior grooves 48, thereby allowing features of a first mold half that form a portion of first latch 58 to be withdrawn axially through interior partition apertures 46 and interior grooves 48 upon completion of the plastic injection molding process. This ease of molding is also permitted due to second latch 64 being axially aligned with exterior partition apertures 47 and exterior grooves 50 which allows the first mold half that forms a portion of second latch 64 to be withdrawn axially through exterior partition apertures 47 and exterior grooves 50 upon completion of the plastic injection molding process.

While this invention has been described in terms of preferred embodiments thereof, it is not intended to be so limited, but rather only to the extent set forth in the claims that follow.

We claim:

1. An electrical splice assembly for placing a plurality of wires in electrical communication, said electrical splice assembly comprising:

an insulative housing extending along an axis and having a forward portion, a rearward portion, and an intermediate portion between said forward portion and said rearward portion; said intermediate portion defining a plurality of axially extending terminal retention cavities;

a conductive bus plate retained within said forward portion of said housing;

a plurality of conductive terminals, each of said plurality of terminals extending into a respective one of said plurality of terminal retention cavities and being in electrical contact with said bus plate;

wherein each of said terminal retention cavities is defined by 1) a pair of opposing sidewalls connected only to said forward portion and to said rearward portion and 2) a pair of opposing retention beams connected only to said forward portion and to said rearward portion, each said retention beam including a latch which engages a respective one of said plurality of terminals to retain said terminals in said terminal retention cavities.

2. An electrical splice assembly as in claim 1 wherein said latches on said opposing retention beams engage a respective one of said plurality of terminals such that said latches simultaneously retain said terminal in a respective one of said terminal retention cavities.

3. An electrical splice assembly as in claim 1 wherein a first outside surface of said forward portion includes a first plurality of grooves such that each one of said first plurality of grooves is axially aligned with a respective one of said latches of a respective terminal retention cavity.

4. An electrical splice assembly as in claim 3 wherein each one of said first plurality of grooves communicates with a respective one of said plurality of terminal retention cavities through a respective first aperture that is axially aligned with a respective one of said latches of a respective terminal retention cavity.

5. An electrical splice assembly as in claim 3 wherein an inside surface of said forward portion includes a second plurality of grooves such that each one of said second plurality of grooves is axially aligned with the other of said latches of a respective terminal retention cavity.

6. An electrical splice assembly as in claim 5 wherein each one of said second plurality of grooves communicates with a respective one of said plurality of terminal retention cavities through a respective second aperture that is axially aligned with the other of said latches of a respective terminal retention cavity.

7. An electrical splice assembly as in claim 6 wherein said bus plate includes a plurality of blades extending from a strip such that each of said plurality of blades extends into a respective one of said plurality of terminal retention cavities through a respective said second aperture and is in electrical contact with a respective one of said plurality of terminals.

8. An electrical splice assembly as in claim 1 wherein each said retention beam is configured to flex outward from a respective terminal retention cavity as each of said plurality of terminals is being inserted axially into said plurality of terminal retention cavities.

9. An electrical splice assembly as in claim 8 wherein each said retention beam is configured to flex independently of every other said retention beam.

10. An electrical splice assembly as in claim 8 wherein each said retention beam is configured to snap inward toward a respective one of said terminal retention cavities when a respective one of said plurality of terminals is fully inserted into a respective one of said plurality of terminal retention cavities.

11. An electrical splice assembly as in claim 1 wherein adjacent said retention beams define axially extending slots therebetween.

12. An electrical splice assembly as in claim 1 wherein said bus plate includes a plurality of blades extending from a strip such that each of said plurality of blades extends into a respective one of said plurality of terminal retention cavities and is in electrical contact with a respective one of said plurality of terminals.

13. An electrical splice assembly as in claim 1 wherein each one of said plurality of blades extend into a respective one of said plurality of terminal retention cavities through a respective aperture.

14. An electrical splice assembly for placing a plurality of wires in electrical communication, said electrical splice assembly comprising:

an insulative housing extending along an axis and having a forward portion, a rearward portion, and an intermediate portion between said forward portion and said rearward portion; said intermediate portion defining a plurality of axially extending terminal retention cavities;

a conductive bus plate retained within said forward portion of said housing;

a plurality of conductive terminals, each of said plurality of terminals extending into a respective one of said plurality of terminal retention cavities and being in electrical contact with said bus plate;

wherein each of said terminal retention cavities is defined by 1) a pair of opposing sidewalls connected only to said forward portion and to said rearward portion and 2) a retention beam connected only to said forward portion and to said rearward portion, said retention beam including a latch which engages a respective one of said plurality of terminals to retain said terminals in said terminal retention cavities.

15. An electrical splice assembly as in claim 14 wherein each said retention beam is configured to flex outward from a respective terminal retention cavity as each of said plurality of terminals is being inserted axially into said plurality of terminal retention cavities.

16. An electrical splice assembly as in claim 15 wherein each said retention beam is configured to flex independently of every other said retention beam.

17. An electrical splice assembly as in claim 15 wherein each said retention beam is configured to snap inward toward a respective one of said terminal retention cavities when a respective one of said plurality of terminals is fully inserted into a respective one of said plurality of terminal retention cavities.

18. An electrical splice assembly as in claim 14 wherein adjacent said retention beams define axially extending slots therebetween.

19. An electrical splice assembly as in claim 14 wherein said forward portion includes a plurality of grooves such that each one of said plurality of grooves is axially aligned with said latch of a respective terminal retention cavity.

20. An electrical splice assembly as in claim 19 wherein each one of said plurality of grooves communicates with a respective one of said plurality of terminal retention cavities through a respective aperture that is axially aligned with said latch of a respective terminal retention cavity.

* * * * *